US008025516B2

(12) United States Patent
Yokoo et al.

(10) Patent No.: US 8,025,516 B2
(45) Date of Patent: Sep. 27, 2011

(54) CONNECTOR HAVING AN ACTUATOR OPERABLE TO HOLD A PLATE-LIKE CONNECTION TARGET BETWEEN TWO METAL ABUTMENT PORTIONS

(75) Inventors: Hiroyuki Yokoo, Tokyo (JP); Masaki Yamashita, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/799,770

(22) Filed: Apr. 30, 2010

(65) Prior Publication Data

US 2010/0304594 A1 Dec. 2, 2010

(30) Foreign Application Priority Data

Jun. 2, 2009 (JP) ..... 2009-133529

(51) Int. Cl.
*H01R 13/15* (2006.01)

(52) U.S. Cl. ..... 439/260; 439/495

(58) Field of Classification Search ..... 439/260, 439/267, 495
See application file for complete search history.

(56) References Cited

U.S. PATENT DOCUMENTS

| | | | | |
|---|---|---|---|---|
| 6,997,729 | B2 * | 2/2006 | Sunaga | 439/260 |
| 7,270,567 | B2 * | 9/2007 | Inoue | 439/495 |
| 7,314,385 | B2 * | 1/2008 | Tsukumo | 439/495 |
| 7,341,477 | B2 * | 3/2008 | Kato | 439/495 |
| 7,347,720 | B2 * | 3/2008 | Takashita | 439/495 |

FOREIGN PATENT DOCUMENTS

| | | |
|---|---|---|
| JP | 2002-124331 | 4/2002 |
| JP | 2006-120429 | 5/2006 |
| JP | 2006-179267 | 7/2006 |

OTHER PUBLICATIONS

Japanese Office Action dated Apr. 21, 2011 with English translation of same.

* cited by examiner

*Primary Examiner* — Thanh Tam Le
(74) *Attorney, Agent, or Firm* — Collard & Roe, P.C.

(57) ABSTRACT

A plate-like connection target is inserted into a connector along a first direction. The connector has a first metal member having a first metal abutment portion, a second metal member having a second metal abutment portion, and an actuator operable to push the second metal abutment portion toward the first metal abutment portion for holding the plate-like connection target between the first metal abutment portion and the second metal abutment portion in a second direction perpendicular to the first direction in a state in which the plate-like connection target has been inserted in the connector.

6 Claims, 8 Drawing Sheets

CONNECTOR HAVING AN ACTUATOR OPERABLE TO HOLD A PLATE-LIKE CONNECTION TARGET BETWEEN TWO METAL ABUTMENT PORTIONS

CROSS REFERENCE TO RELATED APPLICATIONS

Applicants claim priority under 35 U.S.C. §119 of Japanese Patent Application No. JP2009-133529 filed Jun. 2, 2009.

BACKGROUND OF THE INVENTION

The present invention relates to a connector used for a plate-like connection target such as a flexible printed circuit (FPC) or a flexible flat cable (FFC).

For example, this type of connector is disclosed in JP-A 2002-124331, the contents of which are incorporated herein by reference. The connector disclosed in JP-A 2002-124331 is configured such that an FPC or FFC is pressed against metal contacts by part of an actuator formed of an insulating material (pusher).

When an FPC or FFC is pressed against contacts by movement of a pusher along an insertion direction (or removal direction) of the FPC or FFC as in the connector disclosed in JP-A 2002-124331, shearing stress is applied to the FPC or FFC. This shearing stress may cause breakage of the FPC or FFC if connection and disconnection of the FPC or FFC to the connector is repeated. Additionally, if the FPC or FFC is held between a member of metal and a member of an insulating material, stable connection cannot be established by wear of the insulating material.

In contrast to such a connector, JP-A 2006-179267 discloses a connector having metal members to hold an FPC or FFC therebetween. This connector can establish relatively stable connection. Furthermore, according to the connector disclosed in JP-A 2006-179267, no shearing stress that would practically be problematic is applied to the FPC or FFC unlike the connector disclosed in JP-A 2002-124331. Thus, fear of breakage of the FPC or FFC is reduced.

However, the connector disclosed in JP-A 2006-179267 has a structural problem that the size of the connector increases.

SUMMARY OF THE INVENTION

It is, therefore, an object of the present invention to provide a connector capable of reducing fear of breakage of an FPC or FFC without increase in size.

One aspect of the present invention provides a connector into which a plate-like connection target is inserted along a first direction. The connector has a first metal member having a first metal abutment portion, a second metal member having a second metal abutment portion, and an actuator operable to push the second metal abutment portion toward the first metal abutment portion for holding the plate-like connection target between the first metal abutment portion and the second metal abutment portion in a second direction perpendicular to the first direction in a state in which the plate-like connection target has been inserted in the connector.

An appreciation of the objectives of the present invention and a more complete understanding of its structure may be had by studying the following description of the preferred embodiment and by referring to the accompanying drawings.

Figure 1:
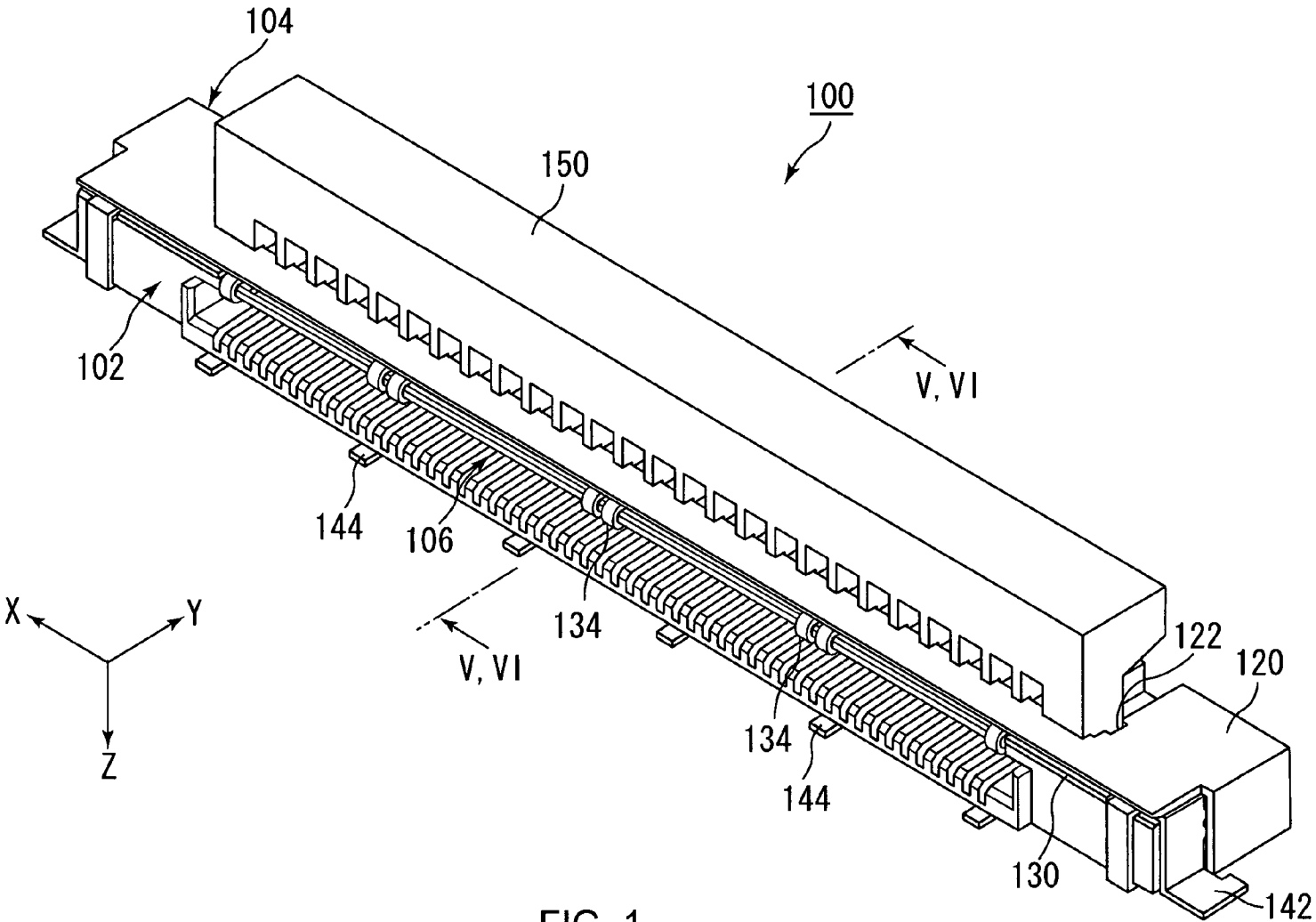
FIG. 1 is a perspective view of a connector according to an embodiment of the present invention as viewed obliquely from a front side of the connector.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1, 2, 5, and 6, a connector 100 according to an embodiment of the present invention has an insertion hole 106 formed on a front end 102 of the connector 100. A plate-like connection target 200 such as an FPC or FFC is inserted into the insertion hole 106 along the Y-direction (first direction). The connector 100 also has a plurality of contacts (first metal members) 110, a housing configured to hold the contacts 110, a shell 130 incorporated into the housing 120 so as to surround at least part of the contacts 110, and an actuator 150 rotatably supported by the housing 120. The connection target 200 of the present embodiment has a signal pattern formed on a lower surface thereof and a ground pattern formed on an upper surface thereof.

Figure 2:
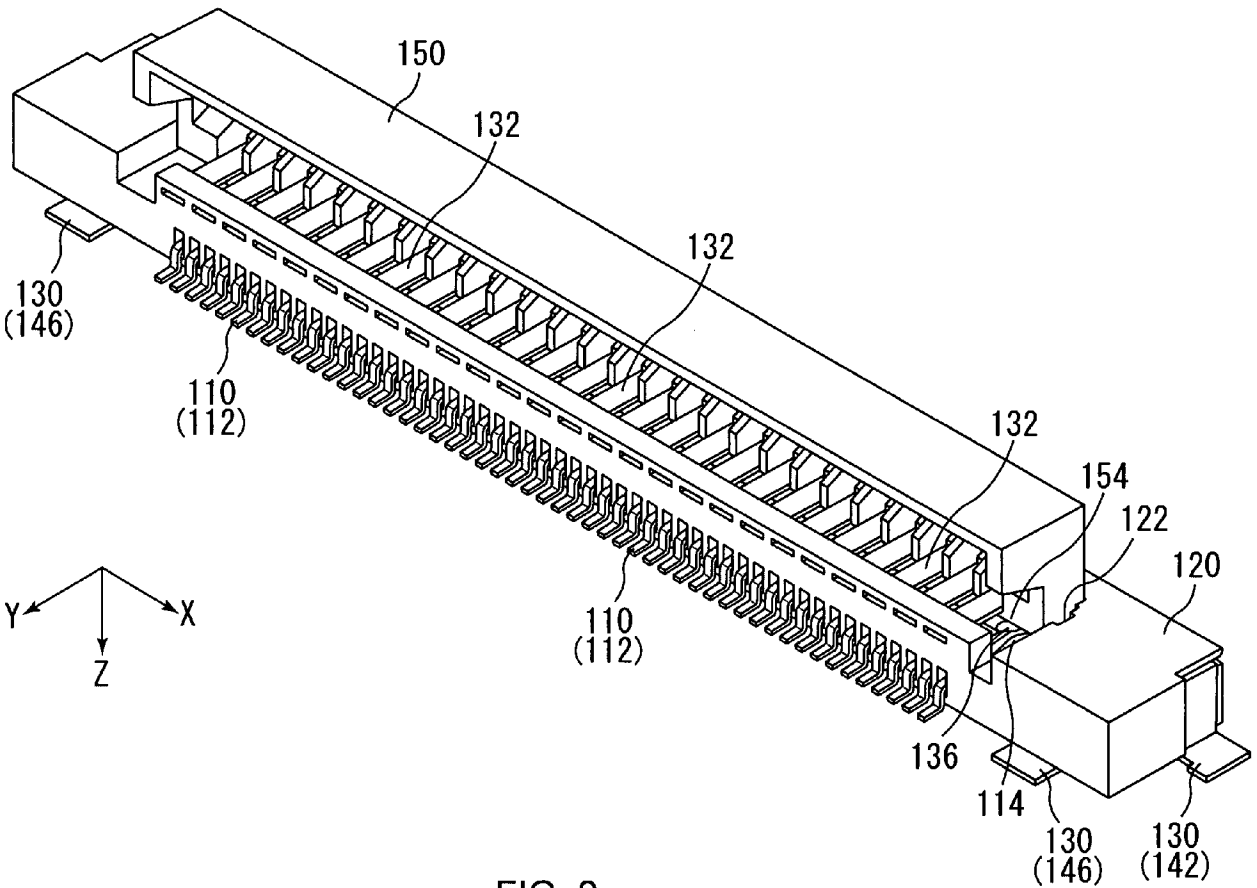
FIG. 2 is a perspective view of the connector of FIG. 1 as viewed obliquely from a rear side of the connector.
Figure 5:
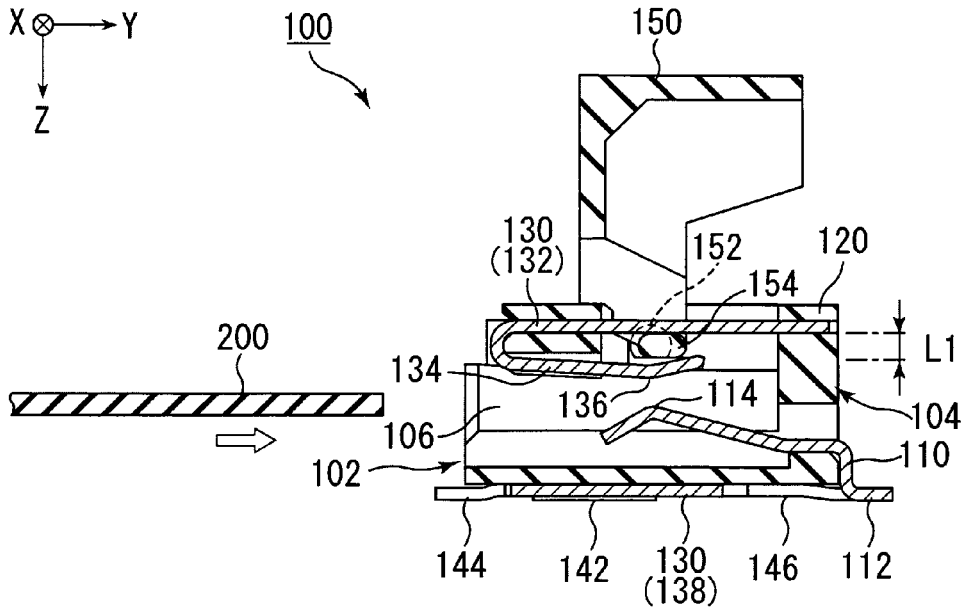
FIG. 5 is a cross-sectional view showing the connector taken along line V-V of FIG. 1, in which an actuator is located at an open position.
Figure 6:
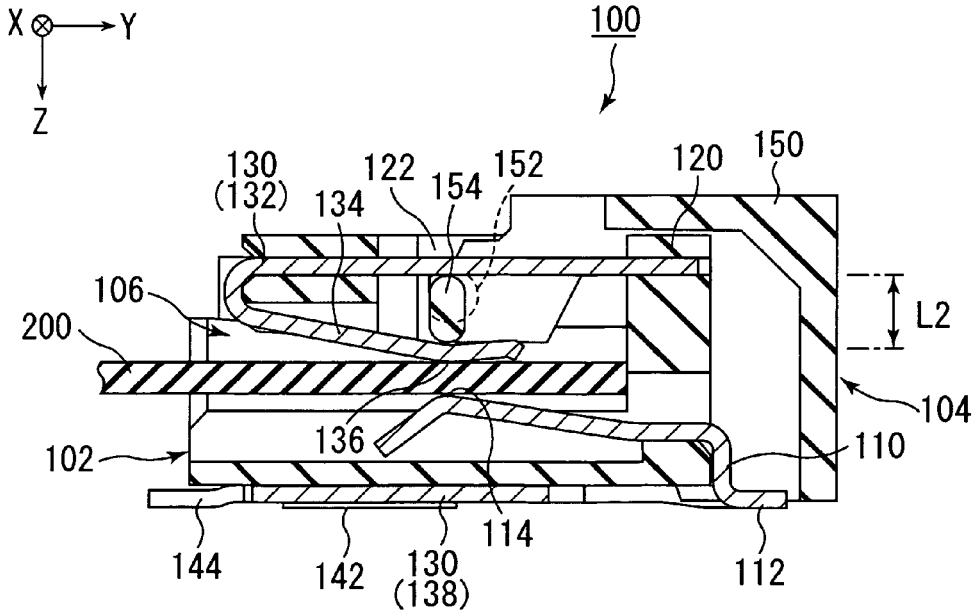
FIG. 6 is a cross-sectional view showing the connector taken along line VI-VI of FIG. 1, in which the actuator is located at a close position.

The contacts 110 are formed of metal. Referring to FIGS. 2, 5, and 6, each of the contacts 110 includes a fixing end 112 connected and fixed to a conductive pattern of a substrate (not shown) on which the connector 100 is mounted. Each of the contacts 110 also includes an abutment portion (first metal abutment portion) 114, which is brought into contact with the signal pattern of the inserted connection target 200. As best illustrated in FIG. 2, the contacts 110 are arranged along the X-direction. As shown in FIGS. 5 and 6, the contacts 110 are fixed to the substrate (not shown) only at the fixing ends 112 and thus cantilevered. Furthermore, in the present embodiment, the fixing ends 112 are located near a rear end 104 of the connector 100. The abutment portions 114 are located between the rear end 104 and the front end 102 of the connector 100. Specifically, the contacts 110 of the present embodiment extend from the rear end 104 toward the front end 102 of the connector 100.

The housing 120 is formed of an insulating material. As shown in FIGS. 1, 2, 5, and 6, the housing 120 has pivotal supports 122 for supporting the actuator 150 so that the actuator 150 is rotatable.

Figure 3:
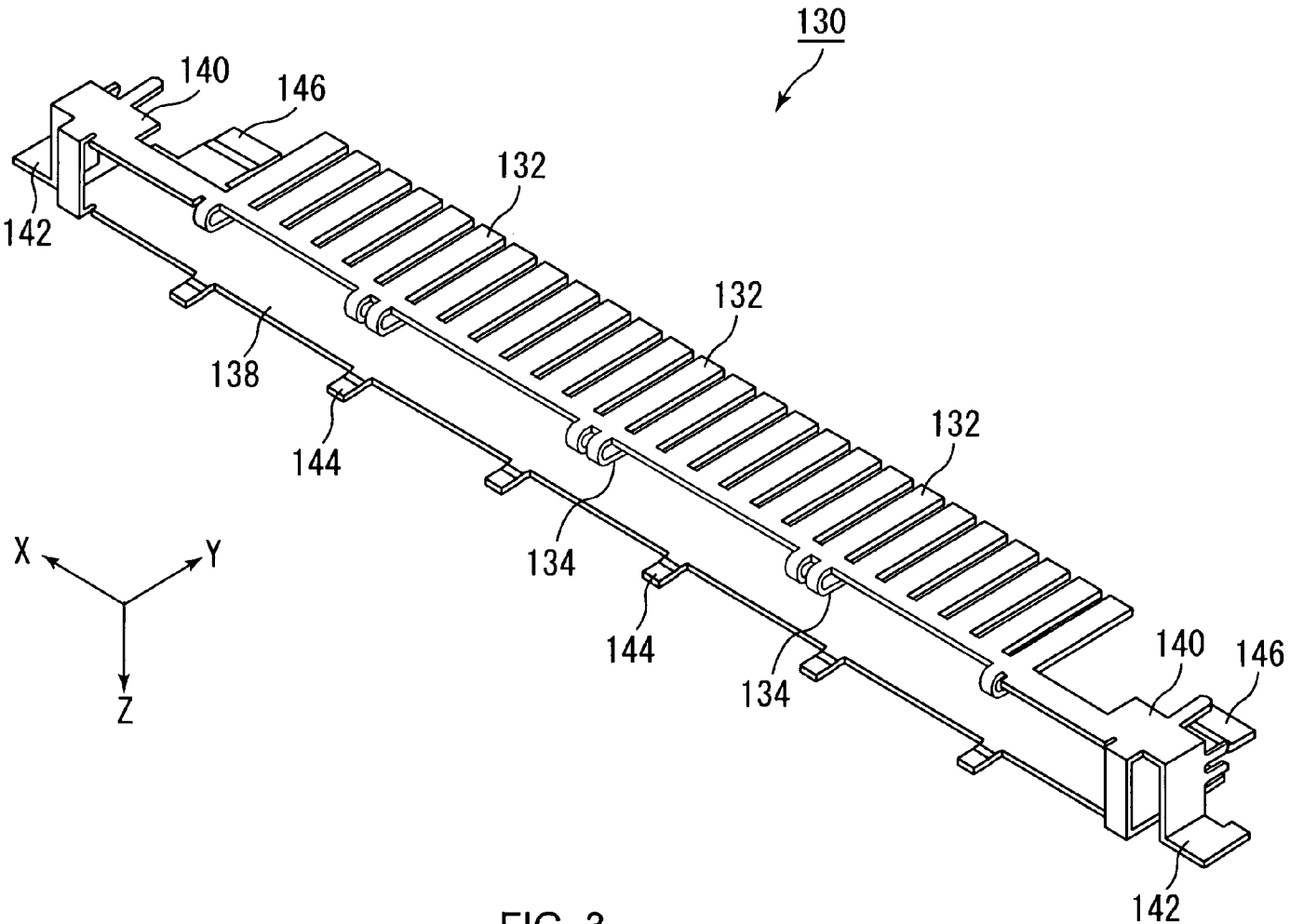
FIG. 3 is a perspective view showing a shell included in the connector of FIG. 1.
Figure 4:
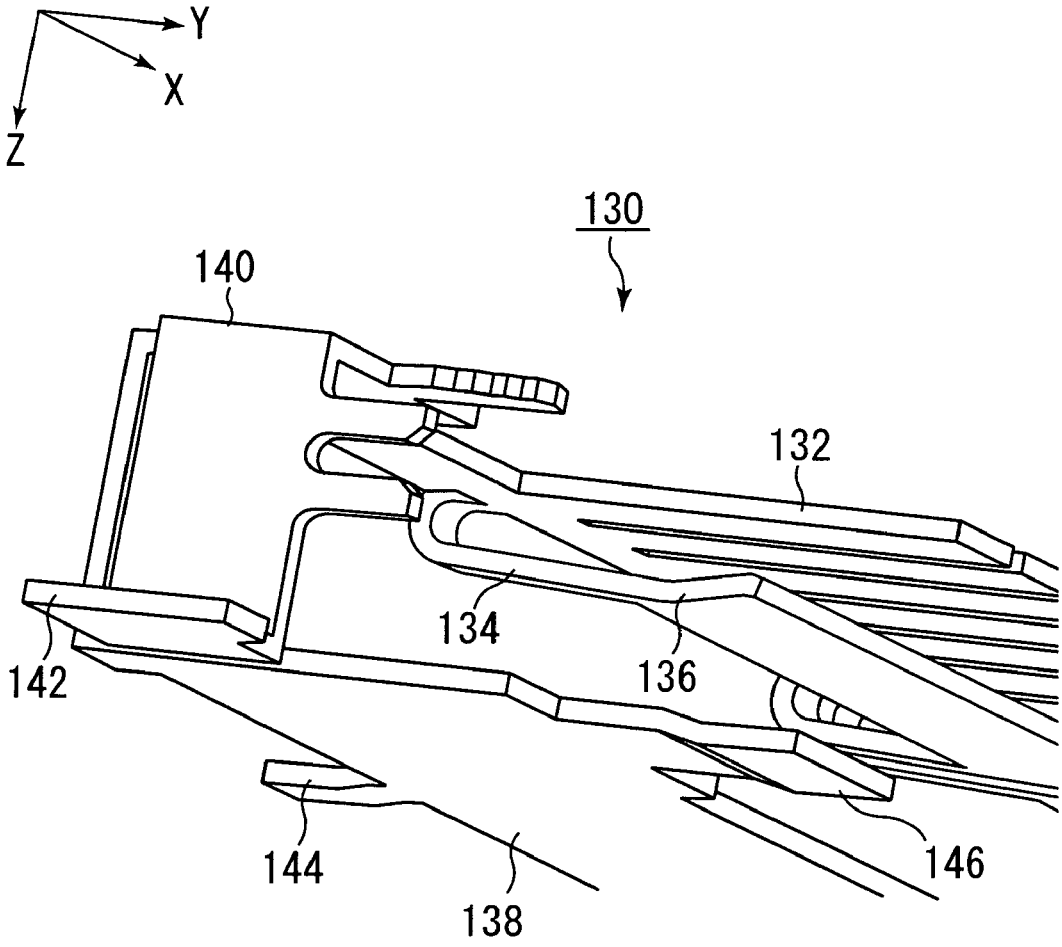
FIG. 4 is a perspective view showing an enlarged part of the shell of FIG. 3 as viewed obliquely from the rear side of the connector.

The shell 130 of the present embodiment is formed of metal. Referring to FIGS. 3 and 4, the shell 130 includes housing connection portions 132, spring portions (second metal members) 134 extending from the housing connection portions 132, a lower plate 138 provided so as to face the housing connection portions 132 in the Z-direction (second direction), and side portions 140 formed on opposite sides of the lower plate 138 in the X-direction. The housing connection portions 132 of the present embodiment form a comblike shape. The housing connection portions 132 are held and fixed onto the housing 120. The spring portions 134 extend in a cantilevered manner so as to return rearward from front ends of the housing connection portions 132. Specifically, as shown in FIGS. 5 and 6, the spring portions 134 of the present embodiment extend continuously from the housing connection portions 132 on the YZ-plane. As shown in FIGS. 4 to 6, the spring portions 134 have abutment portions (second metal abutment portions) 136 formed near tip ends of the spring portions 134. The abutment portions 136 are brought into contact with the ground pattern of the connection target 200. In other words, the abutment portions 136 of the present embodiment are located at a rear side of a boundary between the housing connection portions 132 and the spring portions 134. As shown in FIGS. 3 and 4, each of the side portions 140 has a fixing portion 142 soldered and fixed to the substrate (not shown) on which the connector 100 is mounted. The lower plate 138 also has fixing portions 144 formed on a front end of the lower plate 138 and fixing portions 146 formed on a rear end of the lower plate 138. The fixing portions 144 and 146 are soldered and fixed to the substrate (not shown).

As shown in FIGS. 5 and 6, the aforementioned shell 130 is held by the housing 120 so that the contacts 110 are sandwiched in the Z-direction on a plane perpendicular to the X-direction (YZ-plane). As shown in FIG. 6, the shell 130 and the contacts 110 are attached to the housing 120 so that the inserted connection target 200 is held between the abutment portions 136 and the abutment portions 114 in the Z-direction. Specifically, the abutment portions 114 and the abutment portions 136 are located on virtual lines extending along the Z-direction in a state in which the connection target 200 is held between the abutment portions 114 and the abutment portions 136.

The actuator 150 of the present embodiment is formed of an insulating material. As shown in FIGS. 5 and 6, the actuator 150 includes pivotal portions 152 rotatably supported by the pivotal supports 122 of the housing 120 and a pusher 154 extending between the pivotal portions 152 along the X-direction.

Referring to FIGS. 5 and 6, each of the pivotal portions 152 has a partially cut-out circular shape, i.e., a semicylindrical shape on the YZ-plane, which is illustrated by dashed lines in FIGS. 5 and 6. The pivotal portions 152 are supported by the pivotal supports 122. Thus, the actuator 150 is rotatable about the pivotal portions 152 while movement of the actuator 150 in the Y-direction (or rattling caused by such movement) is restricted. The support of the pivotal portions 152 by the pivotal supports 122 allows the actuator 150 to pivot between an open position (see FIG. 5) and a close position (see FIG. 6).

Referring to FIGS. 5 and 6, the pusher 154 is located between the housing connection portions 132 and the abutment portions 136 in the Z-direction. Furthermore, the pusher 154 of the present embodiment is in the form of an oval track on the YZ-plane. More specifically, the pusher 154 has a first length L1 in the Z-direction when the actuator 150 is located at the open position. The pusher 154 has a second length L2 in the Z-direction when the actuator 150 is located at the close position. The second length L2 is greater than the first length L1. Accordingly, when the actuator 150 is operated to pivot from the open position (in the state of FIG. 5) to the close position (in the state of FIG. 6), the pusher 154 widens spaces between the housing connection portions 132 and the abutment portions 136 and is sandwiched between the housing connection portions 132 and the abutment portions 136. In other words, when the actuator 150 is located at the close position, the pusher 154 pushes the abutment portions 136 toward the abutment portions 114 in a state in which the pusher 154 is brought into contact with the housing connection portions 132. The pusher 154 of the present embodiment is not brought into contact with the spring portions 134 when the actuator 150 is located at the open position. However, the present invention is not limited to this example. The pusher 154 may be brought into contact with the spring portions 134 not only when the actuator 150 is located at the close position, but also when the actuator 150 is located at the open position.

Thus, when the actuator 150 is operated, the pusher 154 pushes the abutment portions 136 toward the abutment portions 114. Thus, the connection target 200 can be held between the abutment portions 136 and the abutment portions 114. Specifically, if the pusher 154 directly pushes the connection target, excessive shearing stress may be applied to the connection target. According to the present embodiment, the pusher 154, which generates pushing forces, is provided separately from the abutment portions 136, which transmit the pushing forces to the connection target 200. Therefore, there is no fear that excessive shearing stress is applied to the connection target when pushing forces are applied to the connection target 200. Thus, according to the present embodiment, it is possible to reduce fear that the connection target 200 is broken when the connection target 200 is sandwiched between the abutment portions 136 and the abutment portions 114. Particularly, according to the present embodiment, the abutment portions 136 and the abutment portions 114 are substantially located on lines extending along the Z-direction when the connection target 200 is held between the abutment portions 136 and the abutment portions 114. Therefore, shearing stress applied to the connection target 200 would be extremely small.

Furthermore, according to the present embodiment, the connection target 200 is held between the abutment portions 136 and 114 provided in a cantilevered manner respectively on the spring portions 134 and the contacts 110. Therefore, the connection target 200 inserted in the connector 100 can firmly be held with high contact reliability.

Moreover, according to the present embodiment, since the spring portions 134 and the housing connection portions 132 are integrally formed, the number of parts can be reduced.

Various modifications can be made to the connector 100 according to the aforementioned embodiment.

Figure 7:
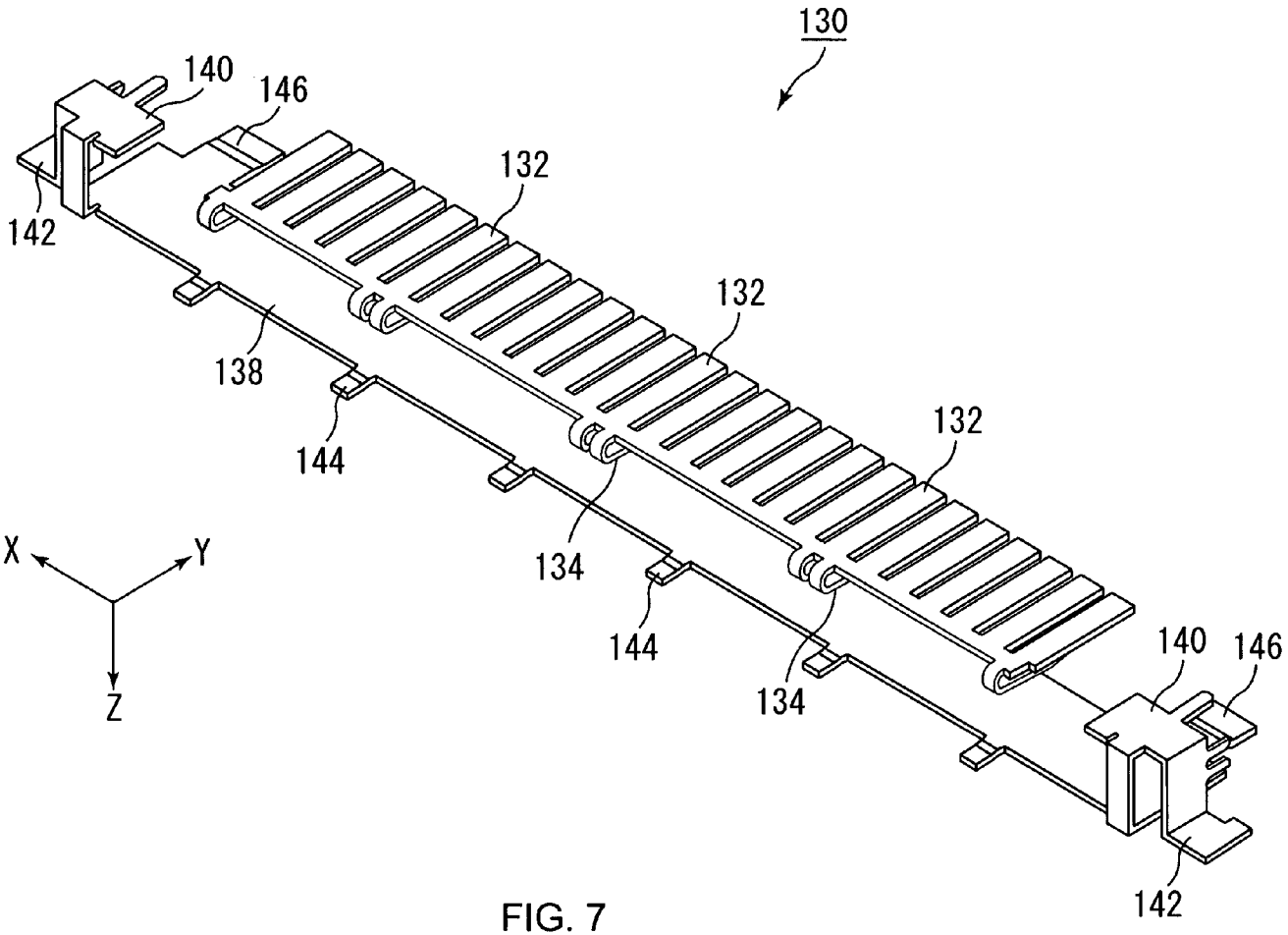
FIG. 7 is a view showing a variation of the shell of FIG. 3.
Figure 8:
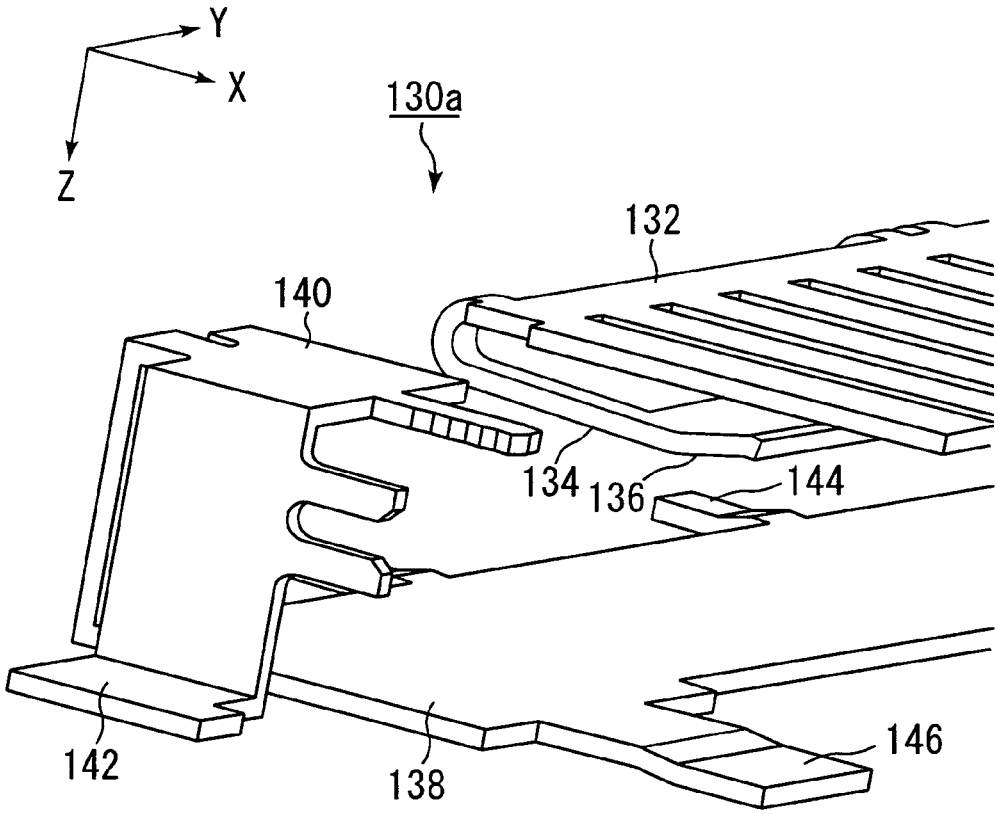
FIG. 8 is a perspective view showing an enlarged part of the shell of FIG. 7 as viewed obliquely from the rear side of the connector.

For example, the shell 130 of the above embodiment includes the housing connection portions 132 and the side portions 140 as shown in FIGS. 3 and 4. The present invention is not limited to this example. For example, as shown in FIGS. 7 and 8, the housing connection portions 132 and the side portions 140 may be separated from each other so as to form a shell 130*a*. In view of proper measures against EMI, it is preferable to use a structure as shown in FIGS. 3 and 4 for the shell 130.

Furthermore, in the above embodiment, the spring portions 134 as the second metal members are formed integrally with the housing connection portions 132. The present invention is not limited to this example. The second metal member may be provided separately from the housing connection portions. Additionally, in the above embodiment, the spring portions 134 as the second metal members extend rearward (from the front end 102 toward the rear end 104 of the connector 100). The present invention is not limited to this example. The second metal member may extend frontward (from the rear end 104 toward the front end 102 of the connector 100).

Figure 9:
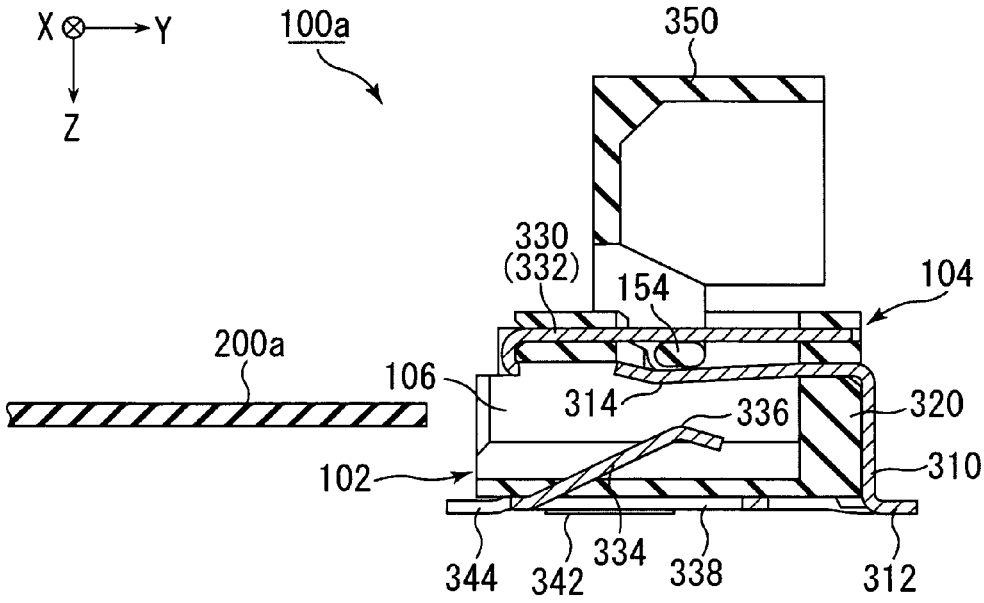
FIG. 9 is a cross-sectional view showing a variation of the connector, in which an actuator is located at an open position.
Figure 10:
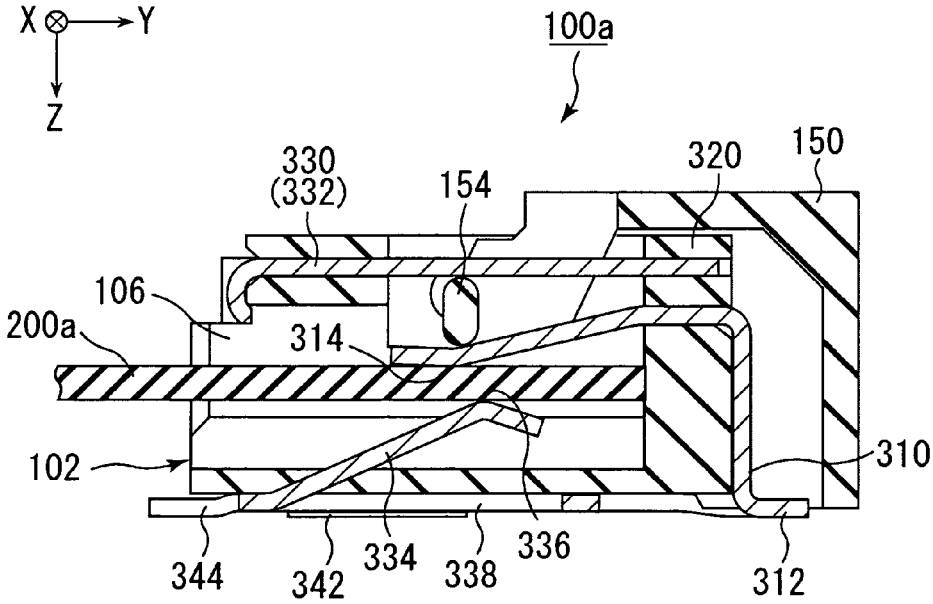
FIG. 10 is a cross-sectional view showing the connector of FIG. 9, in which the actuator is located at a close position.

FIGS. 9 and 10 show a variation in which the second metal member is provided separately from the housing connection portion and in which a tip of the second metal member extends frontward.

A connector 100*a* shown in FIGS. 9 and 10 is used for a connection target 200*a* having a signal pattern formed on an upper surface thereof and a ground pattern formed on a lower surface thereof. The connector 100*a* includes a plurality of metal contacts (second metal members) 310, a housing 320 configured to hold the contacts 310, a metal shell 330 incorporated into the housing 320, and an actuator 150 rotatably supported by the housing 320. The housing 320 and the actuator 150 are formed of an insulating material.

Each of the contacts 110 includes a fixing end 312 fixed to a substrate (not shown) on which the connector 100*a* is mounted. Each of the contacts 110 also includes an abutment portion (second metal abutment portion) 314, which is brought into contact with the signal pattern of the connection target 200*a*. The contacts 310 extend from the rear end 104 toward the front end 102 of the connector 100*a*. The abutment portions 314 are provided near free ends of the contacts 310. Specifically, the abutment portions 314 are located on a front side of the fixing ends 312.

The shell 330 includes housing connection portions 332, a lower plate 338 provided so as to face the housing connection portions 332 in the Z-direction, and spring portions (first metal members) 334 extending from the lower plate 338. The spring portions 334 extend obliquely rearward in a cantilevered manner from the vicinity of a front end of the lower plate 338. The spring portions 334 include abutment portions (first metal abutment portions) 336 provided near free ends of the spring portions 334. The abutment portions 336 are brought into contact with the ground pattern of the connection target 200*a*. The shell 330 includes side portions (not shown) each having a fixing portion 342 soldered and fixed to a substrate (not shown). Furthermore, the lower plate 338 also includes fixing portions 344 soldered and fixed to the substrate.

In the example shown in FIGS. 9 and 10, the abutment portions 336 are located on lines extending along directions in which forces are applied to the abutment portions 314 when the actuator 150 is operated so that the pusher 154 pushes the abutment portions 314 against the connection target 200*a*. In other words, the pusher 154 pushes the abutment portions 314 so that the abutment portions 314 move toward the abutment portions 336. Thus, the connection target 200*a* is held between the abutment portions 336 and the abutment portions 314 pushed by the pusher 154. Therefore, no excessive shearing stress that would bend the connection target 200*a* is applied to the connection target 200*a* in this example. Accordingly, fear of breakage of the connection target 200*a* can be reduced.

Additionally, in the illustrated example, the ground pattern of the connection target 200*a* is connected to a ground portion of the substrate (not shown) through the spring portions 334 and the fixing portions 344. An electric path between the ground pattern of the connection target 200*a* and the ground portion of the substrate is relatively short. Thus, grounding is strengthened. Accordingly, excellent signal transfer characteristics can be obtained in this example.

Furthermore, various modifications can be made to the above embodiment or other variations. For example, the pusher 154 may have a cross-section different from that in the above embodiment as long as it has desired functions as described above. Furthermore, the pusher 154 may extend intermittently along the X-direction. Although the housing connection portions are formed as part of the shell, they may be provided separately from the shell.

In FIG. 5 or 9, for example, a wall of the housing 120 or 320 may be provided between the housing connection portions 132 or 332 and the pusher 154. That is, part of the housing 120 or 320 may be interposed between the housing connection portions 132 or 332 and the pusher 154. Furthermore, although the abutment portions 114 are aligned with the abutment portions 136 in the Y-direction in FIG. 5, the abutment portions 314 may be deviated from the abutment portions 336 in the Y-direction as shown in FIG. 9. Alternatively, the abutment portions 314 may be deviated in an opposite direction to the direction in which the abutment portions 314 are deviated in FIG. 9.

As described above, according to the present invention, a connection target is held between a first metal abutment portion and a second metal abutment portion by an actuator directly pushing the second metal abutment portion toward the first metal abutment portion. Therefore, stable connection can be established without increase in size.

Furthermore, the second metal abutment portion is pushed toward the first metal abutment portion along a direction (second direction) perpendicular to a direction in which the connection target is inserted into the connector (first direction). Therefore, the connection target can be held by the first metal abutment portion and the second metal abutment portion without shearing stress substantially applied to the connection target. Accordingly, a fear of breakage of the connection target can be reduced.

The present application is based on a Japanese patent application of JP2009-133529 filed before the Japan Patent Office on Jun. 2, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector into which a plate-like connection target is inserted along a first direction, the connector comprising:

a first metal member having a first metal abutment portion;

a second metal member having a second metal abutment portion;

an actuator operable to push the second metal abutment portion toward the first metal abutment portion for holding the plate-like connection target between the first metal abutment portion and the second metal abutment portion in a second direction perpendicular to the first direction in a state in which the plate-like connection target is inserted in the connector;

a housing;

a housing connection portion held and fixed to the housing;

a plurality of contacts held by the housing; and a metal shell provided so as to surround the plurality of contacts, the housing connection portion being formed as part of the metal shell, wherein the actuator includes:

(i) a pivotal portion rotatably supported by the housing such that the actuator is pivotable between a close position and an open position, and (ii) a pusher located between the housing connection portion and the second metal abutment portion, wherein the pusher has a first length in the second direction when the actuator is located at the open position and a second length greater than the first length in the second direction when the actuator is located at the close position, and the pusher is operable to push the second metal abutment portion toward the first metal abutment portion through pivotal movement of the actuator from the open position to the close position in such a state that the pusher is brought into contact with the housing connection portion.

2. The connector as recited in claim 1, wherein the actuator is formed of an insulating material, and the housing connection portion is formed of metal.

3. The connector as recited in claim 1, wherein the second metal member extends continuously from the housing connection portion on a plane defined by the first direction and the second direction, the plane including the first metal abutment portion and the second metal abutment portion.

4. The connector as recited in claim 3, wherein the second metal abutment portion is located on a rear side of a boundary between the second metal member and the housing connection portion.

5. The connector as recited in claim 1, wherein the housing connection portion is provided separately from the second metal member.

6. The connector as recited in claim 5, wherein the second metal member has a fixing portion fixed to a substrate, and the second metal abutment portion is located on a front side of the fixing portion.

* * * * *